United States Patent [19]

Jamaux

[11] 3,961,482

[45] June 8, 1976

[54] METHOD AND DEVICE FOR CLEANING A SUPERCHARGING SET POWERING TURBINE DRIVEN BY THE EXHAUST GASES OF A HEAT ENGINE

[75] Inventor: Joseph Auguste Jamaux, Saint-Germain-en-Laye, France

[73] Assignee: Societe d'Etudes de Machines Thermiques, Saint Denis, France

[22] Filed: May 16, 1974

[21] Appl. No.: 470,438

[30] Foreign Application Priority Data

June 19, 1973 France ..... 73.22303

[52] U.S. Cl. ..... 60/606; 123/198 A; 134/169 R; 60/39.09 P

[51] Int. Cl.[2] ..... F02B 33/44

[58] Field of Search ..... 60/597, 598, 606, 39.09 P; 134/20, 22 C, 39, 102, 169 A; 415/116, 121 A; 123/198 A

[56] References Cited

UNITED STATES PATENTS

| | | | |
|---|---|---|---|
| 2,372,538 | 3/1945 | White | 415/116 |
| 3,779,213 | 12/1973 | Knudsen | 134/20 X |
| 3,796,509 | 3/1974 | Wood | 134/169 X |
| 3,797,507 | 3/1974 | Jackson | 134/169 A X |

*Primary Examiner*—Charles J. Myhre
*Assistant Examiner*—R. H. Lazarus
*Attorney, Agent, or Firm*—Kenyon & Kenyon Reilly Carr & Chapin

[57] ABSTRACT

Method and device for cleaning an exhaust gas-driven power turbine of a supercharging set of an internal combustion engine, wherein washing liquid under pressure is fed during the washing periods into injection nozzles fitted onto the inlet ducts for exhaust gases on said turbine and a compressed gas is fed into said injection nozzles outside of the washing periods.

7 Claims, 1 Drawing Figure

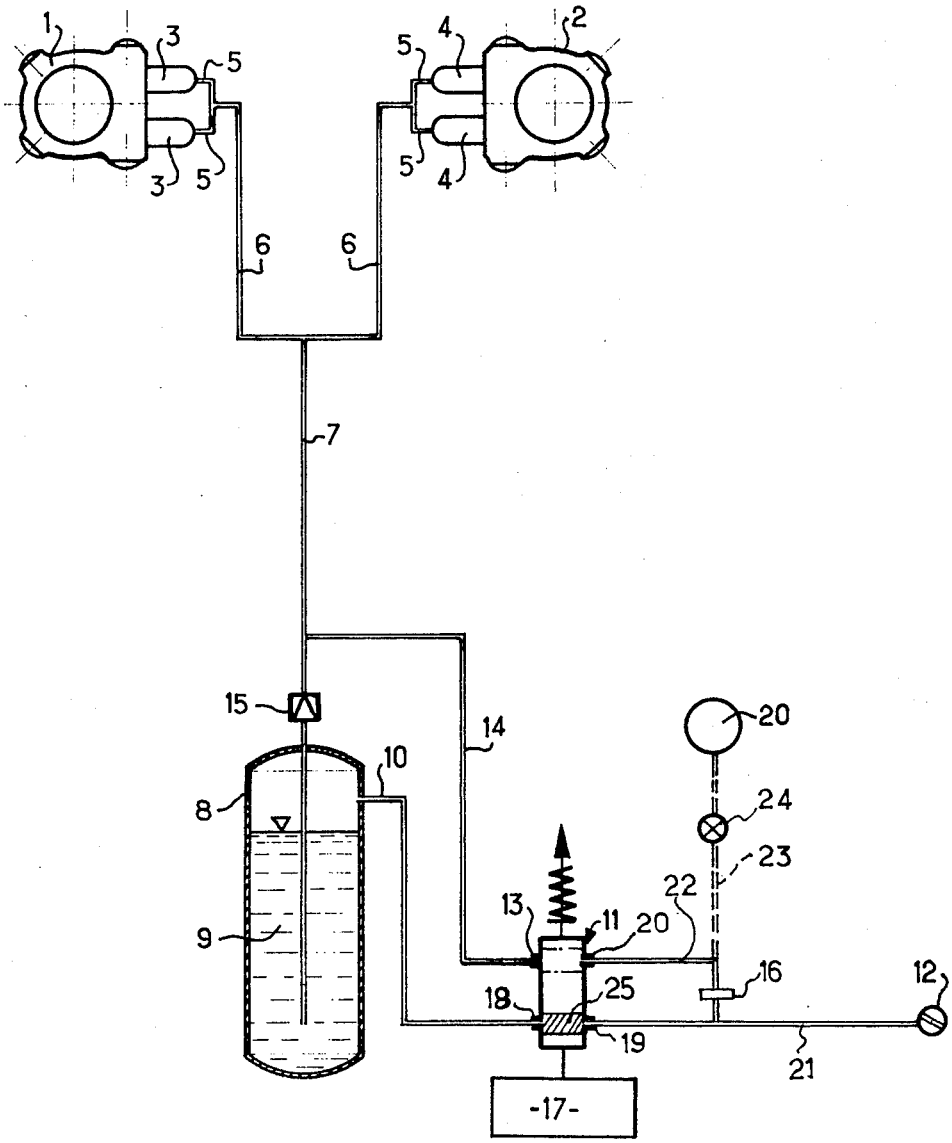
1
2
3
4
5
6
7
8
9
10
11
12
13
14
15
16
18
19
20
21
22
23
24
25
-17-

METHOD AND DEVICE FOR CLEANING A SUPERCHARGING SET POWERING TURBINE DRIVEN BY THE EXHAUST GASES OF A HEAT ENGINE

The present invention relates essentially to a method of cleaning an exhaust gas-driven power turbine of a supercharging set such as a turbine-operated air blower or compressor of a heat engine such as an internal combustion engine, of the kind comprising the steps consisting in feeding a washing fluid or liquid into the turbine through injection nozzles mounted on the inlet ducts or intake pipes for the exhaust gases provided on the turbine as well as to a device for carrying out this process, all the applications and uses resulting therefrom and all the systems, assemblies, machines, engines, automotive vehicles, equipments, plants and installations provided with such a device.

The cleaning for instance through washing of the exhaust gas-driven power turbines of a supercharging set of an internal combustion engine has for its purpose to avoid the formation of significant deposits, settlings or like crust in the course of time upon the vanes of the turbine and on the nozzle rings as well as on possible stopping grids, catch screens and like guards, shielding or protecting members. Generally the washing water is passed through or fed into the injection nozzles mounted on the ingress ducts or like induction pipes for the exhaust gases operating the turbine and flows or circulates inside the latter for removing the deposits and settlings built up on the vanes, on the nozzle rings and on the stopping grids or like catch screens or strainers. The washing water of the turbine is then discharged or drained off and the turbine is dried.

The invention provides a simple and efficient or effective method for cleaning an exhaust gas-driven turbine powering a supercharging set of a heat engine such as an internal combustion engine of the kind previously described, said method consisting in feeding a washing liquid into the inside of the turbine through injection nozzles mounted on the exhaust gas inlet ducts of said turbine and which is characterized by the steps consisting in putting the washing liquid under pressure by means of a compressed gaseous fluid such as compressed air and constantly blowing at times lying outside the washing periods a given flow rate of compressed gaseous fluid into said injection nozzles for permanently scavenging or sweeping them with a gaseous current and thereby avoiding their being clogged, fouled or choked.

This determined compressed gaseous fluid flow rate may for instance be a controlled or timed leak flow rate of compressed air and according to a further characterizing feature of the invention this compressed air leak flow rate is derived or taken from a source or like supply of compressed air and preferably from the supercharging intake manifold of the engine.

The invention also provides a device for carrying out this process and which is characterized in that it comprises at least one washing liquid tank or like vessel or container connected by outlet piping means to said injection nozzles, a source of compressed air as well as preferably automatically operated or selfacting and periodic or programmed control means operating for instance according to a scheduled engineering time for causing the induction of compressed air alternately into the storage tank above the free surface of the liquid contained therein and into said injection nozzles.

Thus the invention enables the cleaning of exhaust gas-driven turbines for powering supercharging sets of internal combustion engines in accordance with the requirements or needs when the device according to the invention is designed for automatic and programmed process control for instance in accordance with a scheduled engineering time and it also enables a steady cleaning of the injection nozzles for the washing liquid mounted on the inlet ducts for the exhaust gases provided on the turbine.

The invention will be better understood and other objects, characterizing features, details and advantages thereof will appear more clearly as the following explanatory description proceeds with reference to the accompanying diagrammatic drawing given by way of example only illustrating a presently preferred specific embodiment of the invention.

At 1 and 2 have been diagrammatically shown exhaust gasdriven turbines for powering a supercharging set of an internal combustion engine such as a Diesel engine and at 3 and 4 are shown the intake or ingress ducts for the exhaust gases leading into both of these turbines, respectively. Injection nozzles 5 are fitted on each one of these ducts and are connected through pipe means 6 to a common outlet pipe 7 of a storage tank 8. The latter contains a suitable washing liquid 9 such as water or any other suitable product and is provided with a piping 10 for the intake of compressed air opening above the free surface of the liquid 9. The open lower or bottom end of the pipe 7 is dipping or submerged into the liquid 9 and extends preferably down to the vicinity of the bottom of the storage tank 8.

The piping 10 is connected to one of the outlets or outputs 18 of an electro-magnetically or solenoid-operated two-way valve 11 the inlets or inputs 19, 20 of which are themselves connected to a common source of compressed air 12, respectively, through a duct 21 and through a duct 22 for instance branched off the duct 21 for instance in by-passing relationship. A duct 14 connects the second output or outlet 13 of the electro-magnetically operated valve 11 to the piping 7 downstream of a check valve 15 mounted on the latter at the outlet of the storage tank 8. The branchedoff or by-passing pipe 22 advantageously comprises a calibrated hole 16 or like apertured plate forming a restriction allowing for air leakage and enabling the passage of a least compressed air flow rate at a given pressure.

The electro-magnetically or solenoid-operated valve 11 is preferably controlled by a programming member or computer 17 which may for instance be a simple time-hour meter or like elapsed-time meter or counter and which is adapted thus to supply either the piping 10 or the piping 14 with compressed air.

The operation of the device which has just been described is as follows:

During the periods required for washing the turbines 1 and 2, the electro-magnetically operated valve 11 enables the supplying of the storage tank 8 with compressed air from the source 12 through the piping 10. The feeding of compressed air into this storage tank results in an injection of water under pressure into the outlet pipe 7 and in supplying the injection nozzles 5 fitted on the inlet ducts 3 and 4 for the exhaust gases provided on the turbines 1 and 2 with washing water under pressure or with any other suitable equivalent liquid product under pressure.

Outside of the washing periods the outlet 13 of the electromagnetically operated valve 11 is then fed with compressed air and an air flow rate controlled or adjusted by the calibrated hole or restriction 16 is steadily admitted into said injection nozzles 5 thereby avoiding their being clogged, choked or fouled as well as cooling them and being conducive to supply extra (although small) power to the turbines 1 and 2.

As also shown in the drawing the source 12 of compressed air may possibly be used to supply if need be a supercharging intake manifold 20 of the internal combustion engine through the pipe 23 (shown in broken phantom lines) containing a valve 24 and for instance branched off the duct 22 downstream of the calibrated hole or restricted passageway 16. This arrangement moreover is adapted to constantly supply the nozzles 5 outside the washing periods by means of the supercharging intake manifold 20 of the engine instead of using the compressed air-loaded storage tank 12. For this purpose the movable distributing member (slide spool or closing piston) 25 of the electro-magnetically operated valve 11 may selectively assume either of the two following end positions: either a lower or bottom position (shown in solid lines in the FIGURE) in which it cuts off the communication between the ducts 10 and 21 while allowing the communication between the ducts 14 and 22, or an upper or top position (shown in dash-dotted lines) in which it cuts off the communication between the ducts 14 and 22 while allowing the communication between the ducts 10 and 21.

It should be understood that the invention is not at all limited to the form of embodiment described and shown which has been given by way of example only. In particular, it comprises all the means forming technical equivalents of the means described as well as their combinations if same are carried out according to the gist and used within the scope of the appended claims.

What is claimed is:

1. A method of cleaning an exhaust gas-driven power turbine for operating a supercharging set of a heat engine such as an internal combustion engine, comprising the steps of putting a washing liquid under pressure by means of a compressed gaseous fluid such as compressed air, feeding said washing liquid during washing periods into said turbine through injection nozzles fitted onto inlet ducts for the exhaust gases on said turbine and constantly blowing outside of the washing periods a determined flow rate of compressed gaseous fluid into said injection nozzles for steadily sweeping or scavanging them with a gaseous current thereby avoiding their being clogged or fouled and their being choked.

2. A method according to claim 1, wherein said determined flow rate of gaseous fluid is a controlled compressed air leak flow rate derived or taken from a source of compressed air and preferably from a supercharging intake manifold of said engine.

3. In combination with an exhaust gas driven power turbine for operating a supercharger set of a heat engine and wherein said turbine includes inlet ducts for exhaust gases, a device for cleaning said exhaust gas driven turbine, said device comprising a washing liquid supply, liquid injection nozzles fitted on said inlet ducts, outlet piping connecting said liquid supply to said injection nozzles, a source of compressed air, and control means for directing compressed air alternately into said liquid supply above the free surface of liquid contained therein and into said injection nozzles.

4. A device according to claim 3, wherein said control means comprises a two-way valve having two inlets, one of said inlets being connected to an outlet from said source of compressed air and timing means for actuating said valve, said valve including at least two valve outlets one of said two valve outlets being connected to said liquid supply, whereas the other one of said two outlets is connected to said piping leading from said liquid supply to said injection nozzles.

5. A device according to claim 4 further comprising check valve means mounted on said outlet piping wherein one outlet of said two valve outlets is connected to said outlet piping from said liquid supply downstream of said check valve means.

6. A device according to claim 4 further including means for connecting one of said two inlet valves to a supercharging intake manifold of said heat engine through a cut-off valve.

7. A device according to claim 4, further including means for connecting said other of said inlets of said two-way valve, which feeds said other outlet of said two-way valve to said compressed air source of supply, through a calibrated passageway for controlling a least leakage flow rate from said source of supply.

* * * * *